US005095791A

United States Patent [19]

Jongerius

[11] Patent Number: 5,095,791

[45] Date of Patent: Mar. 17, 1992

[54] BREAD SLICING MACHINE

[75] Inventor: Sebastiaan C. E. Jongerius, Leersum, Netherlands

[73] Assignee: Jongerius B.V., Al Soesterberg, Netherlands

[21] Appl. No.: 534,039

[22] Filed: Jun. 6, 1990

[30] Foreign Application Priority Data

Jun. 26, 1989 [NL] Netherlands ..... 8901613

[51] Int. Cl.[5] ..... B26D 1/50

[52] U.S. Cl. ..... 83/155; 83/420; 83/425.3; 83/427; 83/435; 83/435.2; 83/751; 83/807; 83/808

[58] Field of Search ..... 83/155, 372, 417, 420, 83/422, 425.2, 426, 427, 435, 435.2, 807, 808, 163, 751, 425.3

[56] References Cited

U.S. PATENT DOCUMENTS

| | | | |
|---|---|---|---|
| 1,910,096 | 5/1933 | Egan et al. | 83/808 X |
| 1,937,332 | 11/1933 | Criner | 83/807 |
| 1,986,189 | 1/1935 | Egan | 83/808 X |
| 2,205,527 | 6/1940 | Hartman | 83/807 |
| 2,254,105 | 8/1941 | Kottmann | 83/751 |
| 2,379,911 | 7/1945 | Kottmann | 83/435.2 |
| 2,437,124 | 3/1948 | Petskeyes | 83/425.2 |
| 3,304,825 | 2/1967 | Preusser | 83/372 X |
| 3,511,122 | 5/1970 | Sherrill et al. | 83/435 X |
| 4,434,692 | 3/1984 | Desert et al. | 83/427 X |

*Primary Examiner*—Douglas D. Watts
*Assistant Examiner*—Eugenia A. Jones
*Attorney, Agent, or Firm*—Wolf, Greenfield & Sacks

[57] ABSTRACT

An apparatus for slicing a loaf of bread includes a frame, first and second drums rotatably coupled to the frame and aligned in a vertical plane, at least one endless slicing band having a cutting edge being passed around the first and second drums to form a figure eight with an up leg and a down leg with the cutting edge of the band up leg facing in the same direction as the cutting edge of the band down leg. A mechanism is provided for rotating the first drum to drive the slicing band in a circle so that the cutting edge of the band up leg and the cutting edge of the band down leg cross each other at a point. The cutting edges have a horizontal velocity at the crossing point so that the cutting edges can engage and pull the loaf through the crossing point at a predetermined velocity. The apparatus further comprises a conveying element for horizontally conveying the loaf at a predetermined velocity into the slicing band at the crossing point.

26 Claims, 2 Drawing Sheets

BREAD SLICING MACHINE

BACKGROUND OF THE INVENTION

The invention relates to a bread slicing machine for use in bakeries, supermarkets and the like, comprising a frame; two drums connected to the frame and being rotatable about substantially horizontal parallel shafts; a plurality of parallely spaced endless drivable slicing bands passed around the drums such that their slicing band parts cross each other between the drums at an acute angle, the slicing bands being drivable in such direction that a component of velocity of the slicing band parts perpendicularly to the plane through the axes of the shafts of the drums at the position of their crossing points is directed in the direction of conveyance of the loafs.

Such a bread slicing machine is described in Dutch patent application no. 8801873 of applicant. Herein, the axis of the slicing band drums lie in a horizontal plane and the loaf is supplied to the slicing bands in a vertical downward direction. The weight of the loaf together with the downwardly directed slicing force of the slicing bands acting on the loaf effect the automatic conveyance of a single loaf.

From the view point of the required floor space in the bakery or supermarket an arrangement with superimposed slicing band drums is preferred. Simply tilting the bread slicing machine of NL-A-8801873 through 90° does not offer an adequate solution in this case since the risk arises of the loaf getting stuck in the slicing bands. Then, the weight of the loaf does not contribute anymore to the force of conveyance.

Of course, in larger industrial bread slicing machines, arrangements with superimposed slicing band drums and substantially horizontal loaf supply are known. However, the correct conveyance of the loaf is ensured therein as a result of a constant stream of abutting loafs pushed through the slicing bands by means of a conveyor disposed in front of the slicing bands and engaging for instance, the ends or the upper and lower side of the loaf; this engaged and driven loaf pushing the loafs lying in front thereof through the slicing bands.

Such a method of loaf conveyance, however, is not suited for use in small bread slicing machines in which it must also be possible to slice one single loaf.

The invention has the object to make a bread slicing machine of the type mentioned in the preamble also suited for substantially horizontal loaf conveyance.

SUMMARY OF THE INVENTION

For this purpose the bread slicing machine according to the invention is characterized in that the plane through the axes of the shafts of the slicing band drums extends substantially vertically, and there being provided guiding means for guiding the loafs, which comprise drivable conveying means extending between the slicing bands from the entrance to the exit of the slicing bands, or through a portion of this path, and forming a support face for the loaf moving substantially in the direction of conveyance of the loaf.

Due to these features each loaf is guided, if necessary, by the conveying means during the whole transport through the slicing bands thereby providing for an additional conveying force, or at least avoiding any counter force to the loaf which would develop if a loaf is sliding along a stationary face. As a result it is sufficient for obtaining a correct and complete transport of the loaf through the slicing bands to have the conveying slicing bands and the conveying means serving as a moving support face. Of course it is possible to provide additional conveying means.

A special embodiment of the bread slicing machine according to the invention is characterized in that the guiding means are arranged above the crossing points of the slicing band parts and serve as upper support face for the loaf.

In a bread slicing machine having crossed slicing bands it may occur that loafs are inclined to move upwardly during the slicing operation so that the loaf "floats" through the slicing bands and rather requires a moving guide at the upper side than at the lower side. For this cases the embodiment described above is very suited.

It is favourable if the guiding means are movable in vertical direction and are loaded downwardly.

An advantageous embodiment is that in which the guiding means are mounted to swivelling arms being swivably suspended to a horizontal transverse shaft arranged in front of the slicing bands.

The weight of the swivelling arms may then already exert a sufficient downward pressure onto the bread, but it is also possible to provide for an additional spring means.

A very favorable embodiment of the invention has the feature that the swivelling arms have such a length and such a rest position that, in their rest position, they are adapted to serve as support means for the ends of the slice loaf.

In this embodiment the swivelling arms with their conveying means, which are above the loaf, serve as guiding means during the slicing operation thereof, while the swivelling arms which are just besides the loaf act as support means for the sliced loaf, for which purpose they engage the heels of the sliced bread.

It is advantageously when the conveying means are endless, extend between all adjacent slicing band parts and are passed around parallel rollers. Preferably the endless conveying means comprise belts, preferably of rubber.

In this way the conveying means can be guided through the slicing bands in a simple manner, while after slicing the loaf each slice of bread is supported by its own conveying means. Of course it would also be possible to arrange one or several driven rollers positioned behind one another, for example, rather than endless conveying means.

It is favorable if at the entrance to the slicing bands there is provided a switching sensor, preferably a micro-switch, to actuate and switch off the drive of the slicing bands.

Due to this feature the drive of the slicing band is automatically switched on and off so that the slicing bands are only driven when it is necessary, and notwithstanding this no complicated operating actions have to be carried out.

Preferably, the bread slicing machine according to the invention comprises an encasement, a loaf supply opening in the encasement on a higher level than the conveying means for the bread and a supply chute extending from the supply opening to the conveying means.

In this embodiment it is sufficient to drop the loaf to be sliced into the supply chute for supplying the loaf to the slicing bands. Herewith it is possible to supply both a single bread and successively a plurality of loafs into the supply chute, wherein in the latter case the supply chute serves as buffer.

It is favorable when the supply chute comprises straight-line means. These straight-line means may include a swing platform mounted to a horizontal pivot at the upper edge of the supply chute, said swing platform having a counter weight on its side facing away from the supply chute or being equipped with a spring means. In its starting position the swing platform inclines downwardly into the supply chute.

Due to this swing platform the loaf needs only to be positioned thereon whereafter the loaf slides along the inclined swing platform as a result of which the swing platform is caused at a certain moment to swing downwardly against the force of the counter weight or the spring. Then the loaf will already be slid along the swing platform to such an extent that the loaf has come to lie against the wall of the supply chute in a straight horizontal position.

BRIEF DESCRIPTION OF THE DRAWINGS

The invention will hereafter be elucidated with reference to the drawing showing embodiments of the bread slicing machine according to the invention by way of example.

In the several figures like parts are indicated with like reference numerals.

DETAILED DESCRIPTION

Figure 2:
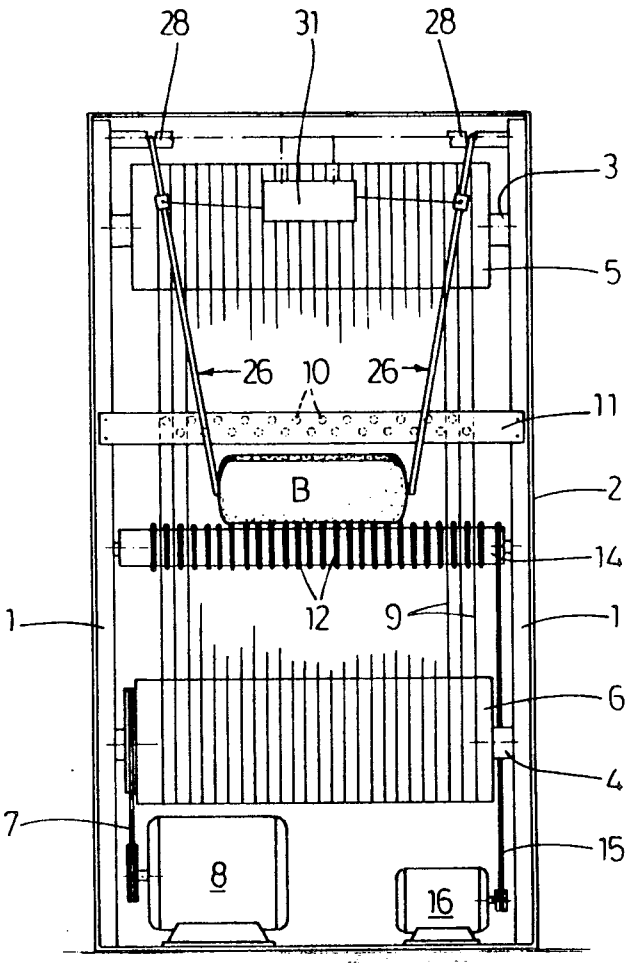
FIG. 2 is a schematic sectional view along the line II—II of FIG. 1, in which a number of parts is omitted for the sake of clarity.

In the drawing there is shown an embodiment of a bread slicing machine intended for use in a supermarket, bakery or the like.

The bread slicing machine comprises a frame generally indicated by reference numeral 1 and to which the various parts are suspended which are encased in an encasement 2. The encasement 2 may, for example, consist of plates or covers made of plastics or metal and being fixed to the frame 1. The bread slicing machine as shown is in principle adapted to be placed on the floor.

By means of horizontal parallel, vertically superimposed shafts 3 and 4, drums 5 and 6 are journalled in the frame 1. Of the drums 5 and 6 the lower drum 6 is drivable by means of a motor, for example an electric motor 8, through V-belt 7. The drums 5 and 6 serve to tension and drive a plurality of substantially parallely spaced endless slicing bands 9 passed around the upper drum 5 and the lower drum 6. In the drawing a portion of the slicing bands 9 is omitted for the sake of clarity.

The slicing bands 9 are provided on one of their sharp sides with cutting teeth for slicing the loaf. Each slicing band 9 is passed over the drums 5 and 6 in such a way that a leading part 9' and a returning part 9'' cross each other between the drums 5 and 6. On the drums 5 and 6 the slicing bands 9 lie with a flat side against the surface of the drums 5 and 6, and between the drums 5 and 6 the slicing bands 9 are twisted 180° about their longitudinal axis. In the center between the drums 5 and 6 the slicing bands 9 are turned 90° to their position on the drums 5 and 6 such that the cutting teeth of the parts 9' and 9'' are directed to the same side. For accurately directing the slicing bands 9 in their slicing zone the bread slicing machine includes lower guide pins (not shown) and upper guide pins 10 fixedly mounted to a holder 11 and extending between each pair of adjacent slicing band parts 9' and 9'' and contacting the sides thereof. In this manner the spacing between the slicing band parts 9' and 9'' and consequently the thickness of the loaf slices is determined by the thickness of the guide pins 10.

The loafs to be sliced are guided through the slicing bands 9 in a horizontal position substantially symmetrically a to the crossing points between the slicing band parts 9' and 9'', wherein the direction of rotation of the drums 5, 6 is such (see arrow A at drum 6 in FIG. 1) that the horizontal velocity components of the slicing band parts 9' and 9'' at the position of their crossing points are directed in the direction of conveyance of the loaf so that also the slicing forces acting on the loaf are directed in the direction of conveyance of the loaf and the loafs are, as it were, being pulled automatically through the slicing bands 9.

To promote the supply of the loaf to the slicing bands 9 and the discharge of the sliced loaf there are provided guiding means consisting of drivable conveying means being arranged between the slicing bands 9 from the entrance to the exit of the slicing bands 9 and thereby forming a moving support face for the loaf. In the embodiment shown by way of example the conveying means consist of endless belts 12 passed around rollers 13 and 14 extending parallel to the shafts 3 and 4. The number of belts 12 is so big that between each pair of adjacent slicing band parts 9' and 9'' a belt 12 extends so that each slice of bread is eventually supported by its own belt 12. The belts 12 are driven by the roller 13 being rotated by a motor, such as an electric motor 16, through a chain 15. This electric motor 16 is adapted to be switched on and off by means of push buttons 17 on the outer side of the encasement 2.

The conveying means, that is the belts 12 in the embodiment shown, not only take care of the supply of the loaf B to the slicing bands 9 and the discharge of the sliced bread, but also serve for reducing the resistance to the loaf during slicing since the belts 12 move substantially as fast as the loaf is pulled through the slicing bands 9. As a result thereof the loaf does not encounter a counter force during the slicing operation and the loaf will never get stuck in the slicing bands 9.

On the inlet side of the slicing bands 9 there is arranged a switch 18, for example a micro-switch, having a rotable arm 19, against which the loaf will run up during its supply thereby causing the arm 19 to rotate resulting in activating the switch 18 and starting the drive of the slicing bands 9. As long as the arm 19 is kept from its vertical starting position by the transported loaf the drive of the slicing bands 9 remains switched on. As soon as the loaf comes out of engagement with the arm 19 the arm 19 returns by spring force to its vertical starting position and the drive of the slicing bands 9 being switched off again until a subsequent loaf arives.

The loaf B to be sliced is supplied to the bread slicing machine through a vertical supply chute 20 debouching through a bend portion 20' above the horizontal belts 12. The chute 20 starts on the upper side of the encasement 2 so that the loafs B can be supplied from the upper side of the bread slicing machine. The supply opening of the supply chute 20 is closed by a swing platform 21 adapted to swing about a pivot 22 in its center and being retained by a counter weight 23 in a starting position inclining downwardly in a direction to the supply chute 20. In order to supply a loaf B to the supply chute 20 it is only necessary to place the loaf onto the swing platform 21 whereafter the loaf automatically slides in the direction to the supply chute 20 and the swing platform 21 swings after a delay as a consequence of the weight of the loaf B thereby causing a loaf B to drop into the supply chute. As a result of the delayed rotation of the platform 21 due to the counter weight 23 the loaf B slides over the platform 21 against the wall of the supply chute 20 whereby the loaf comes to lie in a horizontal position.

Into the supply chute 20 are projecting two spaced pins 24 extending horizontally in a starting position. These pins 24 project through the wall of the chute 20 and are downwardly pivotable as a whole against a return force. The pins 24 are adapted to catch the supplied loaf B and bring it into a horizontal position, if necessary, so that the loaf B is supplied to the slicing bands 9 in the right position.

In the supply chute 20 are also extending centering means 25 to center and to transversely guide the supplied loaf B up to the slicing bands 9. The centering means 25 are connected to support means 26 arranged behind the slicing bands 9 and being adapted to engage the ends of the loaf already sliced in order to retain the relationship of the slices thereof and to prevent the slices of the loaf from falling over to the sides. The connection between the centering means 25 and the support means 26 causes the centering means 25, which automatically adjust to the length of the loaf to be sliced, to also automatically adjust the support means 26 so that they can always receive the sliced loaf in the right position.

The centering and support means 25, 26 together consist of two continuous bent rods, of which the upper horizontal portions 27 are journalled in supports 28. A lower horizontal rod portion 29 of the centering means 25 just terminates in front of the slicing bands 9, while a lower horizontal rod portion 30 of the support means 26 starts at a short distance behind the slicing bands 9. Each lower rod portion 30 of the support means 26 being essentially aligned with the respective lower rod portion 29 of the centering means 25, wherein the ends of the rod portions 30 may have a slightly outwardly extending starting portion. Both rods of the centering and support means 25 and 26 are interconnected by a balance and return device 31 causing the deflections of both rods to be equal and to load both rods towards one another. The balance and return device 31 may, for instance, consist of a tumbler lever assembly or rack assembly loaded by a weight or a spring. Preferably the return force on both rods is substantially independent of the rotational position of the rods of the centering and support means 25, 26. For this purpose it is also possible to displace the upper horizontal portions 27 of the rods in their supports 28.

As seen in the direction of conveyance of the loaf, behind the slicing bands 9 is arranged another conveying roller 32 for conveying the loaf B to outside the encasement 2. The rotatable conveying roller 32 is suspended in a resilient and vertically adjustable manner and is driven by the roller 13 through a belt 35 which is tensioned by a tensioning means 33 and guided over a roller 34.

A discharge opening 36 for the loaf B is provided in the encasement 2 and closed by a plurality of adjacent lamellas 38 being suspended on their upper ends from a pivot shaft 37 and being able to swing outwardly but not inwardly from their vertical rest position. At least a part of the lamellas 38 is provided with a carrier means 39 ensuring that when the lamellas 38 are pivoted by the loaf B the lamellas 38 hanging just outside the length of the bread are carried along through a smaller angle, whereby the loaf lying on a dispensing platform 40 adjacent the discharge opening 36 is bordered by a lamella 38 preventing the outer slices of the loaf to tip over outwardly.

The operation of the bread slicing machine as shown is as follows.

For supplying a loaf B it may be placed onto the swing platform 21 where the loaf B slides downwardly due to the inclination of the swing platform 21, the swing platform 21 rotating downwardly due to the weight of the loaf and the loaf B falling into the supply chute 20. Therein the loaf meets the pins 24 causing the loaf B to descend further in a horizontal position. During the further descent the loaf B comes into engagement with the centering means 25 of which the rods are pushed away from each other against the return force such that the loaf is positioned in the center of the row of slicing bands 9. Through the bend portion 20 of the wall of the supply chute 20 the loaf B is supplied to the upper part of the belts 12 in a lying position, said upper part of the belts 12 moving in the direction of conveyance of the loaf and supplying the loaf B to the slicing bands 9. Just before the loaf B contacts the slicing bands 9, the switch arm 19 is actuated by the loaf B thereby switching on the drive of the slicing bands 9. Then the loaf is transported through the slicing bands 9 wherein the forces exerted by the slicing bands 9 onto the loaf B are sufficient to convey the loaf through the slicing bands 9. The sliced bread is received, after leaving the slicing bands 9, between the horizontal lower rod portions 30 of the support means 26 being adjusted to the right length of the loaf by means of the centering means 25. The loaf B is then further conveyed in between the horizontal lower rod portions 30 by means of the belts 12 and the conveying roller 32, the loaf B running up against the lamellas 38 of the discharge opening 36 and pivoting them outwardly. The lamellas 38 being suspended next adjacent the loaf pivot through a smaller angle than the lamellas 38 above the loaf whereby the loaf, when it is lying on the dispensing platform 40, is still retained as a whole and cannot fall apart. In this position the loaf may be taken away or may be brought into a container bag by an automatic packing machine. The supply point for the loaf to be sliced (swing platform 21) and the discharge point of the sliced loaf (dispensing platform 40) are positioned on a ergonomically favourable height so that an easy and comfortable operation is possible.

Figure 1:
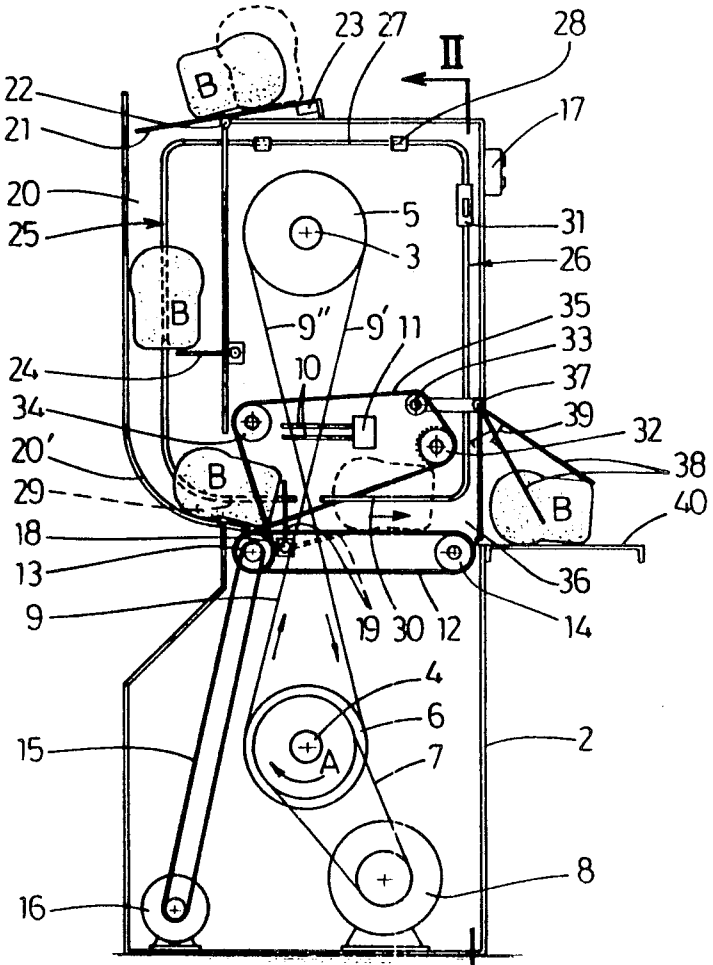
FIG. 1 is a schematic vertical sectional view of an embodiment of the bread slicing machine according to the invention by way of example.
Figure 4:
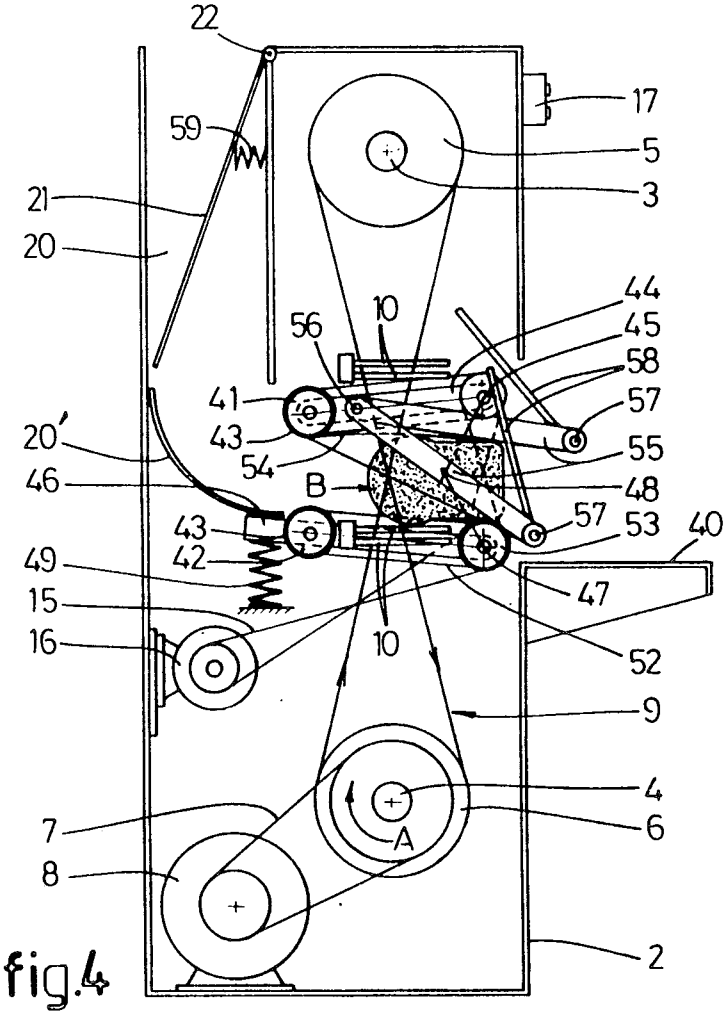
FIG. 3 and 4 are sectional views corresponding to that of FIG. 1 and showing a further embodiment of the bread slicing machine according to the invention in two different positions.
Figure 3:
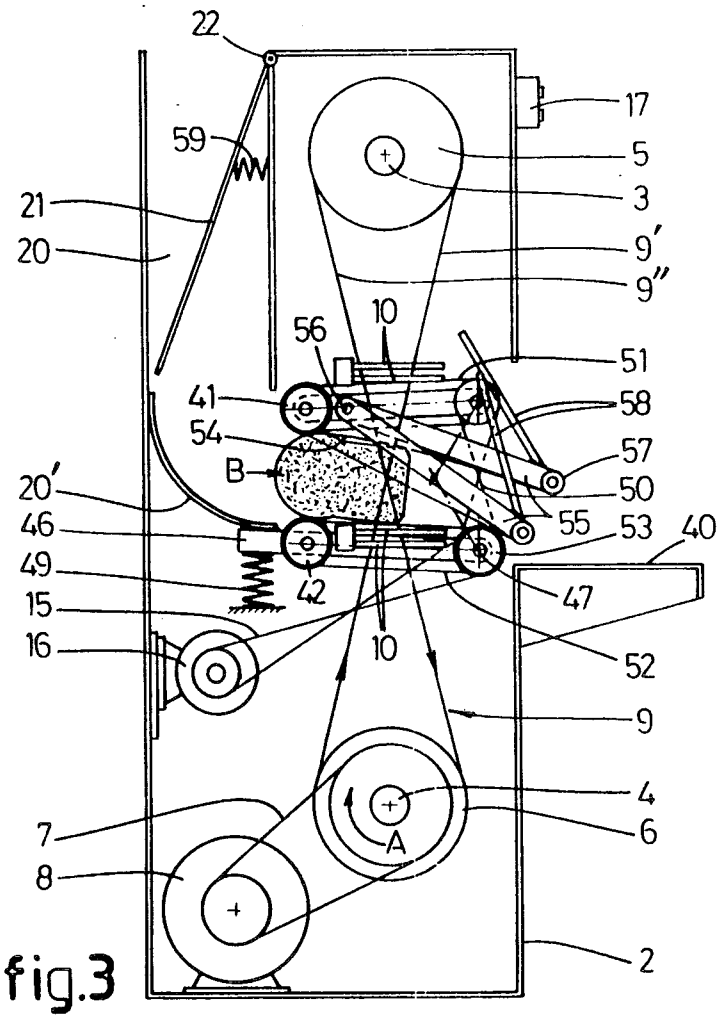

FIGS. 3 and 4 show a modified embodiment of the bread slicing machine according to the invention having the same basic structure as the first embodiment according to FIG. 1 and 2, but wherein a modified conveyance and guiding system for the loaf is provided.

Behind the lower end of the supply chute 20 and in front of the slicing bands 9 are arranged lower and upper conveying rollers 41, 42. These conveying rollers 41, 42 are covered with a nappy cover 43 in order to engage the loafs B and convey them without slippage. The upper conveying roller 41 is journalled at its end by a swivelling arm 44 being suspended swivable about a shaft 45. In the same way the lower conveying roller 42 is supported at each end on a swivelling arm 46 being swivable about a shaft 47. Both swivelling arms 44 and 46 are interconnected by coupling arms 48 such that they swivel together symmetrically to the crossing points of the slicing band parts 9' and 9''. By a spring means 49 the conveying rollers 41, 42 are biased towards each other. In this manner an arriving loaf B of any dimension will always be supplied to the slicing bands 9 symmetrically with respect to the crossing points of the slicing band parts 9' and 9''. For driving the conveying rollers 41 and 42 there is provided the electric motor 16 being in driving connection with the conveying rollers 41, 42 by means of the driving belts 15, 50, 51 and 52.

On a prolongation of the lower swivelling arms 46 is arranged the bend portion 20' of the the supply chute 20 so that this lower bend portion 20' is adjusted together with the lower conveying roller 42 as a result of which the bend portion 20' will always terminate in a right way in relation to the lower conveying roller 42.

At the outlet of the slicing bands 9 there is provided a further lower conveying roller 53 being drivable by the electric motor 16 through the belt 15 and being adapted to support and convey the sliced loaf.

In this embodiment by way of example, in lieu of the conveying means 12 guiding the loaf during the slicing process in the slicing bands 9 on the lower side, there are provided conveying means 54 being arranged above the crossing points of the slicing band parts 9' and 9'' and guiding the loaf B on the upper side. Such guiding means is used in those cases where the loaf B is inclined to move upwardly during slicing and therefore "float" as it were between the slicing band parts 9' and 9''. A lower moving guide is then not needed. In the embodiment shown the lower guiding pins 10 for the slicing bands 9 can serve as stationary guide for the loaf B in order to prevent the loaf B from dropping for one reason or another. As soon as the loaf B contacts the guiding pins 10 during the slicing action, the developing friction between the loaf B and the guiding pins 10 will develop a force component on the loaf B causing the loaf to immediately move slightly upwardly. Of course it would be possible to combine the conveying means 12 of the embodiment of FIG. 1 and 2 with the upper conveying means 45 according to the present embodiment of FIG. 3 and 4.

The endless conveying means 54 consist of belts each being guided around a swivelling arm 55 and the driven conveying roller 41. One end of each swivelling arm 55 is swivably mounted to a horizontal transverse shaft 56 positoned in front of the slicing bands 9. At its free end each swivelling arm has a reversing roller 57 around which the belt 54 extends. The belts 54 are guided around the driven upper conveying roller 41 at the position of notches therein. Since the belts 54 are elastic it is not necessary that the point of rotation of the swivelling arms 55 coincides with the axis of the upper conveying roller 41 serving as reversing roller for the belts 54. The shaft 56 of the swivelling arms 55 is mounted on the swivelling arm 44 of the conveying roller 41 so that an adjustment of the conveying roller 41 simultaneously involves an adjustment of the point of rotation of the swivelling arms 55.

In FIG. 3 and 4 a front swivelling arm 55 is shown in its rest position in which it rests with its conveying means 54 on the conveying roller 53. When a loaf B is sliced it will cause the swivelling arms lying in front thereof to swivel upwardly, as is illustrated by one of the swivelling arms 55 in FIG. 3 and 4. In this manner the conveying means 54 of the swivelling arms 55 above the loaf B form a moving support face for the slices of the loaf B. The swivelling arms being positioned just adjacent the loaf B extend such that they can serve as transverse support means for the sliced loaf B in order to prevent the loaf from falling apart to one side or another. As a result thereof no separate support means for the ends of the sliced loaf B are required.

The swivelling arms 55 are further provided with safety pins 58 being fixed in an inclined position near the respective reversing roller 57 and preventing a person from contacting the slicing bands 9 with the hand.

In FIGS. 3 and 4 is can further be seen that the swing platform 21 at the entrance of the supply chute 20 is constructed slightly different from that of the embodiment of FIGS. 1 and 2 and in this case, in lieu of a counter weight, the swing platform 21 is loaded towards its rest position 20 by means of a spring means 59.

The embodiments of the bread slicing machine described hereinbefore are particularly adapted to slice a single bread of any dimension, but it is also possible to supply a plurality of breads successively to the bread slicing machine.

The invention is not restricted to the embodiment described hereinbefore and shown in the drawing by way of example, which can be varied in different manners within the scope of the invention. For instance it is possible to position the support face for the loaf and/or the plane of symmetry of the slicing bands 9 under a small angle to the horizontal or vertical respectively without leaving the scope of the invention. Also other slicing means than endless slicing bands can be used, such as slicing wheels, knifes or the like. Furthermore the support or conveying face for the loafs may consist of one or a plurality of driven disc rollers of which the disks engage between the swivelling arms 55 and so forming a moving support face above the loaf B. The weight of this rollers can then be sufficient for downwardly loading the swivelling arms 55.

What is claimed is:

1. Apparatus for slicing a loaf of bread, said apparatus comprising:

a frame, first and second drums rotatably coupled to the frame, said drums being aligned in a vertical plane;

at least one endless slicing band having a cutting edge and being passed around the first and second drums so that the band forms a figure-eight with an up leg and a down leg and the cutting edge of the band up leg faces in the same direction as the cutting edge of the band down leg;

means for rotating said first drum to drive said slicing band in a circle so that the cutting edge of the band up leg and the cutting edge of the band down leg cross each other at a point and the cutting edges have a horizontal velocity at the crossing point so that the cutting edges can engage and pull the loaf through the crossing point at a predetermined velocity; and means for horizontally conveying the loaf at the predetermined velocity, said conveying means being positioned to convey the loaf into the slicing band at the crossing point.

2. Apparatus for slicing a loaf of bread according to claim 1 wherein the conveying means comprises a horizontal conveyor belt on which the loaf rests.

3. Apparatus for slicing a loaf of bread according to claim 1 further comprising a plurality of slicing bands arranged in planes parallel to each other, each of the slicing bands being passed around the first and second drums so that each band forms a figure-eight with an up leg and a down leg and the cutting edge of each band up leg faces in the same direction as the cutting edge of each band down leg.

4. Apparatus for slicing a loaf of bread according to claim 3 wherein the conveying means comprises a plurality of conveyor belts, each of said belts fitting between a pair of the plurality of slicing bands.

5. Apparatus for slicing a loaf of bread according to claim 3 wherein the conveying means comprises a plurality of horizontal conveyor belts across which the loaf rests, each of said belts fitting between a pair of the plurality of slicing bands.

6. Apparatus for slicing a loaf of bread according to claim 1 wherein the conveying means comprises:

a first pivoted arm extending from a first side of said crossing point past the crossing point to a second side of the crossing point;

a second pivoted arm extending from a first side of said crossing point past the crossing point to a second side of the crossing point, the first arm engaging one side of the loaf on the first side and the second arm engaging the other side of the loaf on the first side, both of the arms being pivoted at points on the second side of the crossing point; and means for positioning the first pivoted arm and the second pivoted arm so that the loaf is conveyed into the crossing point, the size of the loaf being variable up to a predetermined limit.

7. Apparatus for slicing a loaf of bread according to claim 6 wherein the conveying means further comprises a first driven conveying roller mounted on the first pivoted arm on the first side of the crossing point, a second driven conveying roller mounted on the second pivoted arm on the first side of the crossing point, the first and second driven conveying rollers being biased towards each other by the positioning means.

8. Apparatus for slicing a loaf of bread according to claim 7 wherein the conveying means further comprises:

a swivelling arm having a pivot at one end connected to the first pivoted arm at a point on the first side and a guide roller at the other end;

an endless drive belt passing around the first driven conveying roller and the guide roller; and means for driving the drive belt around the first driven conveying roller and the guide roller.

9. Apparatus for slicing a loaf of bread according to claim 8 wherein the swivelling arm is urged towards the lower drive belt by spring means.

10. Apparatus for slicing a loaf of bread according to claim 7 wherein the conveying means further comprises a rear conveying roller; means for driving said rear conveying roller and a lower drive belt passing around the second driven conveying roller and the rear conveying roller.

11. Apparatus for slicing a loaf of bread according to claim 7 further comprising a plurality of swivelling arms, each of the swivelling arms having a pivot at one end connected to the first pivoted arm at a point on the first side and a guide roller at the other end;

an endless drive belt passing around the first conveying roller and the guide roller; and means for driving the drive belt around the first conveying roller and the guide roller and wherein the conveying means further comprises a rear conveying roller; means for driving said rear conveying roller and a lower drive belt passing around the second driven conveying roller and the rear conveying roller, the swivelling arms, in a rest position moving towards the lower drive belt to serve as supports for the ends of the loaf after the loaf has passed through the slicing band.

12. Apparatus for slicing a loaf of bread according to claim 11 further comprising:

an encasement surrounding said frame and having a supply opening and a discharge opening extending therethrough, the supply opening disposed above the conveying means.

13. Apparatus for slicing a loaf of bread according to claim 12 wherein each of the swivelling arms is provided with a safety means which slides across and blocks the discharge opening when each swivelling arm is in its rest position.

14. Apparatus for slicing a loaf of bread according to claim 12 wherein the loaf has a top and a bottom and the apparatus further comprises guide means for receiving the loaf in a substantially upright position with the loaf top above the loaf bottom and for rotating the loaf approximately ninety degrees so that the loaf bottom faces the slicing band.

15. Apparatus for slicing a loaf of bread according to claim 14 wherein the guide means comprises a vertical supply chute extending from the supply opening in the encasement through which the loaf drops and a curved section which rotates the loaf ninety degrees.

16. Apparatus for slicing a loaf of bread according to claim 15 wherein the guide means further comprises:

a receiving platform pivotally mounted along an edge of the supply opening and extending, in a rest position, downwardly into the supply chute; and means for biasing the receiving platform to the rest position.

17. Apparatus for slicing a loaf of bread according to claim 16 further comprising a dispensing platform coupled to the encasement adjacent said discharge opening.

18. Apparatus for slicing a loaf of bread according to claim 17 wherein the discharge opening has a top and a bottom and the slicing apparatus further comprises a plurality of lamellas, each of said lamellas being pivotally suspended from the discharge opening top and extending across the discharge opening, the lamellas being located side-by-side to block the discharge opening when no loaf is present.

19. Apparatus for slicing a loaf of bread having a top and a bottom, said apparatus comprising:

a frame, first and second drums rotatably coupled to the frame, said drums being aligned in a vertical plane;

at least one endless slicing band having a cutting edge and being passed around the first and second drums so that the band forms a figure-eight with an up leg and a down leg and the cutting edge of the band up leg faces in the same direction as the cutting edge of the band down leg;

means for rotating said first drum to drive said slicing band in a circle so that the cutting edge of the band up leg and the cutting edge of the band down leg cross each other at a point and the cutting edges have a horizontal velocity at the crossing point so that the cutting edges can engage and pull the loaf through the crossing point at a predetermined velocity; and guide means for receiving the loaf in a substantially upright position with the loaf top above the loaf bottom and for rotating the loaf approximately ninety degrees so that the loaf bottom faces the slicing band; and means for horizontally conveying the rotated loaf at the predetermined velocity, said conveying means being positioned to convey the loaf into the slicing band at the crossing point.

20. Apparatus for slicing a loaf of bread according to claim 19 wherein the guide means comprises a chute having a vertical section through which the upright loaf drops and a curved section which rotates the loaf ninety degrees.

21. Apparatus for slicing a loaf of bread according to claim 19 wherein the conveying means comprises a horizontal conveyor belt on which the loaf rests.

22. Apparatus for slicing a loaf of bread according to claim 19 wherein the conveying means comprises:

a first pivoted arm extending from a first side of said crossing point past the crossing point to a second side of the crossing point;

a second pivoted arm extending from a first side of said crossing point past the crossing point to a second side of the crossing point, the first arm engaging one side of the loaf on the first side and the second arm engaging the other side of the loaf on the first side, both of the arms being pivoted at points on the second side of the crossing point; and means for positioning the first pivoted arm and the second pivoted arm so that the loaf is conveyed into the crossing point, the size of a loaf being variable up to a predetermined limit.

23. Apparatus for slicing a loaf of bread according to claim 22 wherein the conveying means further comprises a first driven conveying roller mounted on the first pivoted arm on the first side of the crossing point, a second driven conveying roller mounted on the second pivoted arm on the first side of the crossing point, the first and second driven conveying rollers being biased towards each other by the positioning means.

24. Apparatus for slicing a loaf of bread according to claim 23 wherein the conveying means further comprises:

a swivelling arm having a pivot at one end connected to the first pivoted arm at a point on the first side and a guide roller at the other end;

an endless drive belt passing around the first conveying roller and the guide roller; and means for driving the drive belt around the first conveying roller and the guide roller.

25. Apparatus for slicing a loaf of bread according to claim 24 wherein the conveying means further comprises a rear conveying roller; means for driving said rear conveying roller an a lower drive belt passing around the second conveying roller and the rear conveying roller.

26. Apparatus for slicing a loaf of bread according to claim 25 wherein the swivelling arm is urged towards the lower drive belt by spring means.

* * * * *